US009162801B2

(12) United States Patent
Mallard

(10) Patent No.: US 9,162,801 B2
(45) Date of Patent: Oct. 20, 2015

(54) PRODUCT CONTAINER

(75) Inventor: Elliott A. Mallard, Ocala, FL (US)

(73) Assignee: Bolso, LLC, Cheyenne, WY (US)

( * ) Notice: Subject to any disclaimer, the term of this patent is extended or adjusted under 35 U.S.C. 154(b) by 329 days.

(21) Appl. No.: 13/614,234

(22) Filed: Sep. 13, 2012

(65) Prior Publication Data

US 2014/0013716 A1 Jan. 16, 2014

Related U.S. Application Data

(63) Continuation of application No. 13/546,374, filed on Jul. 11, 2012, now abandoned.

(51) Int. Cl.

| | |
|---|---|
| ***B65B 51/04*** | (2006.01) |
| ***B65D 39/00*** | (2006.01) |
| ***B65D 43/22*** | (2006.01) |
| ***B65D 37/00*** | (2006.01) |
| *B65B 1/04* | (2006.01) |

(52) U.S. Cl.

CPC . *B65D 37/00* (2013.01); *B65B 1/04* (2013.01); *B65D 2207/00* (2013.01); *B65D 2313/02* (2013.01)

(58) Field of Classification Search

CPC ..... B65D 33/2508; B65D 5/60; B65D 5/606; B65D 33/2591; B65D 5/12; B31B 2201/295

USPC ..... 53/449, 175, 170, 458, 467; 383/97; 229/125.37, 125.39

See application file for complete search history.

(56) References Cited

U.S. PATENT DOCUMENTS

| | | | | | |
|---|---|---|---|---|---|
| 2,177,919 | A | * | 10/1939 | Vogt | 53/512 |
| 2,288,105 | A | * | 6/1942 | Plotkin | 190/119 |
| 2,328,798 | A | * | 9/1943 | Gardner | 156/160 |
| 2,352,503 | A | * | 6/1944 | Walton | 53/173 |
| 2,364,012 | A | * | 11/1944 | Walton et al. | 229/117.28 |
| 2,514,867 | A | * | 7/1950 | Howard et al. | 53/449 |
| 3,249,286 | A | * | 5/1966 | Palmer | 383/109 |
| 3,255,950 | A | * | 6/1966 | Marcouly et al. | 229/117.13 |
| 3,314,210 | A | * | 4/1967 | Jarund | 53/449 |
| 4,082,216 | A | * | 4/1978 | Clarke | 229/164.1 |
| 4,905,898 | A | * | 3/1990 | Wade | 239/6 |
| 5,228,616 | A | * | 7/1993 | Kjelgaard | 229/123.1 |
| D451,794 | S | * | 12/2001 | Ichikawa | D9/709 |
| 6,374,579 | B1 | * | 4/2002 | Muller | 53/449 |
| 6,676,011 | B2 | * | 1/2004 | Luu et al. | 229/117.33 |
| 7,380,703 | B2 | * | 6/2008 | Ogden | 229/117.13 |
| 7,389,909 | B2 | * | 6/2008 | Crosland et al. | 229/117.35 |
| 7,887,473 | B2 | * | 2/2011 | Nagata et al. | 493/218 |
| D634,646 | S | * | 3/2011 | Belko et al. | D9/709 |

(Continued)

*Primary Examiner* — Stephen F Gerrity
*Assistant Examiner* — Eyamindae Jallow
(74) *Attorney, Agent, or Firm* — Larson & Larson, P.A.; Frank Liebenow; Patrick Reid

(57) ABSTRACT

A soft sided container that, when filled, is substantially cuboid in shape and has two flaps extending from upper edges of the front and rear panels. The flaps have fold lines such that, the flaps fold together. Holes cut in upper regions of the flaps form handles. Lengthwise across a top panel of the container is an elongated closure device that opens for accessing of the materials stored within and closes to seal the container. The elongated fastener continues at least partially across two triangular side flaps such that, when open, one of the triangular side flaps serves as a pouring spout. In some embodiments, a side flap retainer is connected between the side flaps to removably hold the side flaps in place against the top of the container.

12 Claims, 4 Drawing Sheets

(56) References Cited

U.S. PATENT DOCUMENTS

| | | | | |
|---|---|---|---|---|
| D643,716 | S * | 8/2011 | Kozarsky et al. | D9/434 |
| 7,992,739 | B2 * | 8/2011 | Garcia | 220/7 |
| D712,735 | S * | 9/2014 | McCracken et al. | D9/430 |
| 2005/0051573 | A1 * | 3/2005 | Crosland et al. | 222/105 |
| 2006/0193541 | A1 * | 8/2006 | Norcom | 383/200 |
| 2008/0230406 | A1 * | 9/2008 | Cuomo | 206/175 |
| 2011/0017812 | A1 * | 1/2011 | Belko et al. | 229/117.27 |
| 2011/0017814 | A1 * | 1/2011 | Belko et al. | 229/124 |
| 2011/0297680 | A1 * | 12/2011 | Howell et al. | 220/266 |
| 2011/0301006 | A1 * | 12/2011 | Howell et al. | 493/84 |
| 2012/0060449 | A1 * | 3/2012 | Howell et al. | 53/456 |
| 2012/0187182 | A1 * | 7/2012 | Howell et al. | 229/102 |

* cited by examiner

PRODUCT CONTAINER

CROSS-REFERENCE TO RELATED APPLICATION

This application is a continuation of U.S. patent application Ser. No. 13/546,374, filed Jul. 11, 2012, the disclosure of which is hereby incorporated by reference.

FIELD

This invention relates to the field of packaging, particularly to a container suitable to for transporting non-liquid products.

BACKGROUND

Granular or powdered materials, like cat litter, pet food and grain are typically manufactured, transported, and dispensed from a variety of containers, including paper and biaxially oriented polypropylene (BOPP) bags, boxes, bag-in-boxes (BIB), pails and buckets. For larger quantities up to 40 to 50 pounds, the containers are typically paper and BOPP bags, BIB's and pails/buckets (four to five gallons).

Paper and BOPP bags are sealed at each end by stitching through crepe tape (one to two inch paper or BOPP strips). The ends of the bags are typically v-shaped, which makes the package difficult to display or store in a vertical position. Additionally, once the package is opened, the contents often spill due to the v-shaped bottom of the bag. Since paper and BOPP bags are not self-supporting, they are usually palletized, transported, shelved and advertised in a horizontal position. The horizontal position allows visibility of only a small portion of the container from the end, reducing visibility of advertisements and product claims and requiring greater storage area (shelf space). Paper and BOPP bags that are in excess of 20 pounds and are difficult to carry and typically do not have a handle.

Another typical package for such products is pails and buckets, which are generally constructed from high density polyethylene (HDPE). Buckets and pails typically have a snap on/off lid comprised of HDPE and a handle made of either HDPE or metal. Both types of handles often have a HDPE cover or grip to provide comfort while carrying the package. Buckets and pails are often difficult to carry due to their diameter, requiring the individual to attempt to carry the container at a position away from their leg at an awkward position. Oftentimes the bucket will hit the individual's leg during transport interfering with walking. The snap on/off lids are often difficult to open and/or close to re-seal. While it is easy to access the material via the snap on/off lid, the product cannot be easily dispensed from the container due to the bulk and weight of the container. Buckets and pails can be recycled due to the fact that they are constructed from HDPE. If the container has a metal handle, it must be separated from the container and the HDPE handle cover must be removed from the handle. During recycling, the bucket/pail is rigid, does not compress and consumes excessive space during transportation and at the recycling facility. Storage and palletizing efficiency is reduced, due to the fact that empty space exists between buckets and pails. Some buckets and pails are square or rectangular shaped to reduce the empty space, but do not completely eliminate the space.

BIB's and boxes for granular and powdered material are constructed of corrugated paper. Boxes or BIB's typically have a top handle made of HDPE or two handles cut into the corrugated paper at the top of each side of the container. Boxes are sealed to prevent the material from leaking from the container, while the BIB utilizes a polyethylene bag to contain the product. Boxes and BIB's are typically sealed at the top by tape. While this type of container provide easy access to the material within, it is difficult to dispense the material from the bulky container. The boxes are also difficult to carry as described above due to the bulky nature container and the location of the handles on the package. The HDPE handle is uncomfortable while carrying the container and the side handles often tear while being carried. Boxes and BIB's are either square or rectangular shaped and eliminate wasted space during transportation. Additionally, boxes and BIB's eliminate wasted space on shelves and the front panel can be utilized for advertising and product claims. While these containers are constructed from recyclable corrugated paper, they are rigid and must be deconstructed prior to recycling. The BIB's and boxes with HDPE handles must be removed prior to recycling. The polypropylene bag in the BIB must be disposed of separately.

What is needed is a container for granular or powdered material that is ergonomic (easy to carry, provides easy access to and allows the product to be dispensed easily), economic (costs less than HDPE containers or corrugated paper), ecologic (uses less material than HDPE or corrugated paper containers, can be re-used and recycled) and efficient (no space between packages during transport, better utilization of shelf space and conformable to the product in the container).

SUMMARY

A container typically made of a pliable material such as BOPP (polypropylene film that is extruded and stretched in X and Y directions) that possesses sufficient tensile strength to, for example, pass a standardized drop test with up to 50 pounds of product. The container, when filled, is substantially cuboid (or cube) in shape and has two flaps extending from upper edges of the front and rear panels. The flaps have fold lines such that, the flaps fold together and holes cut in upper regions of the flaps form handles for convenient transportation of the container and contents. Lengthwise across a top panel of the container is an elongated closure device (zipper, Velcro or Ziploc) that opens for accessing the materials stored within and closes to seal the container. The elongated closure device continues at least partially across two triangular side flaps such that, when open, the triangular side flaps serve as pouring spouts. In some embodiments, a side flap retainer is connected between the side flaps to removably hold the side flaps in place against the top of the container and to stow the flaps during filling and transportation.

In one embodiment, a container is disclosed including four connected and substantially rectangular panels including a front panel, rear panel, left panel and right panel. The container is sealed on the bottom by a substantially rectangular bottom section that has four edges. Each edge of the bottom section is connected to a respective bottom edge of a corresponding one of the four substantially rectangular panels. A first flap extends from an upper edge of the front panel and has a first fold line. The first fold line is substantially parallel to the upper edge of the front panel and divides the first flap into an upper first flap and a lower first flap. A second flap extends from an upper edge of the rear panel and has a second fold line. The second fold line is substantially parallel to the upper edge of the rear panel and divides the second flap into an upper second flap and a lower second flap. When the first flap is bent to approximately 90 degrees at the first fold line and the second flap is bent to approximately 90 degrees at the second fold line, the upper first flap abuts the upper second flap. A top section completes and seals the container. Each edge of the top section is connected to one of the upper edge of the front panel, the upper edge of the rear panel and upper edges of each of the left and right panel. The top section, the front panel, the rear panel the left and right panels and the bottom section are for containing a dry material, and when filled, substantially form a cuboid.

In another embodiment, a method of transporting a material is disclosed including inverting a container as previously described so that the bottom section is facing upwardly. The bottom section is bifurcated into a first bottom panel and a second bottom panel and the edge of the first bottom panel closest to the second bottom panel is disengaged with the edge of the second bottom panel closest to the first bottom panel. Next, the container is filled with the material then the edge of the first bottom panel closest to the second bottom panel is affixed to the edge of the second bottom panel closest to the first bottom panel, thereby sealing the container (e.g. by stitching, adhesives, heat-seal, etc.). The container is then inverted such that the first flap and the second flap are upward and picked up and carried by the first flap and the second flap.

In another embodiment, a container for holding, storing and transporting dry materials is disclosed. The container includes four connected and substantially rectangular panels: a front panel, rear panel, left panel and right panel. A substantially rectangular bottom section includes four edges, such that each edge of the bottom section is connected to a respective bottom edge of a corresponding one of the four substantially rectangular panels enclosing a bottom area of the container. A first flap extends from an upper edge of the front panel and has a first fold line. The first fold line is substantially parallel to the upper edge of the front panel and divides the first flap into an upper first flap and a lower first flap. A first handle hold is cut/formed in the upper first flap. A second flap extends from an upper edge of the rear panel and has a second fold line. The second fold line is substantially parallel to the upper edge of the rear panel and divides the second flap into an upper second flap and a lower second flap. A second handle hold is cut/formed in the upper second flap. When the first flap is bent to approximately 90 degrees at the first fold line and the second flap is also bent to approximately 90 degrees at the second fold line, the upper first flap abuts the upper second flap. The container has a top section. Each edge of the top section is connected to one of the upper edges of the front panel, the upper edge of the rear panel and upper edges of each of the left and right panel, thereby closing the container for holding a dry material such that the container substantially forms a cuboid. The top section of the container has a first and second triangular side flap and a side flap retainer. A first edge of the first triangular side flap is connected to the upper edge of the left panel and a first edge of the second triangular side flap is connected to the upper edge of the right panel. A first end of the side flap retainer is interfaced to a vertex of the first triangular side flap and a distal end of the side flap retainer is interfaced to a vertex of the second triangular side flap, thereby urging the vertex of the first triangular side flap towards the vertex of the second triangular side flap and urging the first and second triangular side flaps to lay against the top section. The side flap retainer has a fastener that disengageably connects a first length of the side flap retainer that is interfaced to the vertex of the first triangular side flap from a second length of the side flap container that is interfaced to the vertex of the second triangular side flap. Thereby, when the fastener is disengaged, the first triangular side flap and second triangular side flaps are free to bend outwardly and away from the top section. The top section also includes an elongated closure device running substantially parallel to both the upper edge of the front panel and the upper edge of the rear panel and continuing across a portion of each of the first and second triangular side flaps. The elongated closure device has a closed position in which the container is sealed and an opened position in which access to the material in the container is provided.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
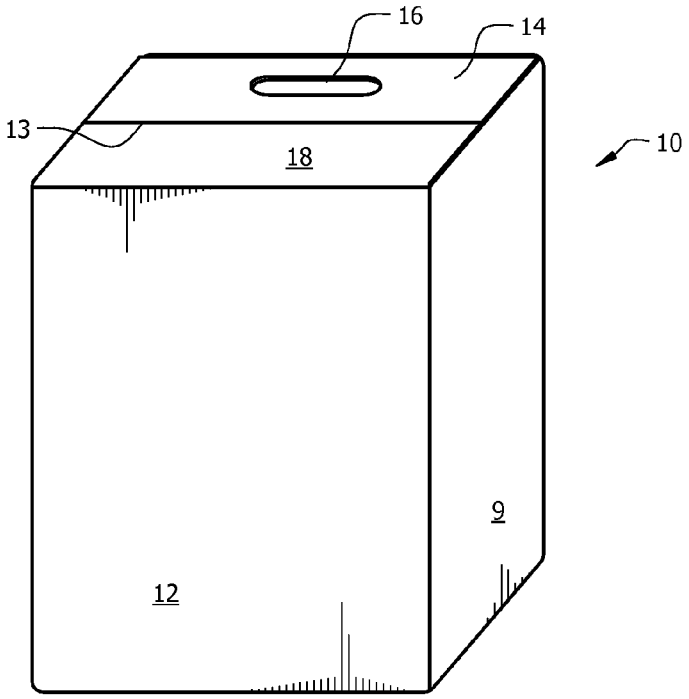
FIG. 1 illustrates a perspective view of a container, with handles flat against the top of the container.

Reference will now be made in detail to the presently preferred embodiments of the invention, examples of which are illustrated in the accompanying drawings. Throughout the following detailed description, the same reference numerals refer to the same elements in all figures.

Although the container disclosed is ideal for advertising, transporting, storing and dispensing pet products such as litter (e.g. granular clay) or animal food, the container is not limited to any particular use or contained material. It is anticipated that the disclosed container be used to contain any loose, solid, powdered or granular material, including, but not limited to: cement, pebbles, stones, sand, mulch, softener salt, pool chemicals, laundry detergent, cereal, grain, seed, fertilizer, etc. The disclosed container is also useful for use with many other forms of dry material such as rags, clothing, nails, scrap, etc.

Figure 2:
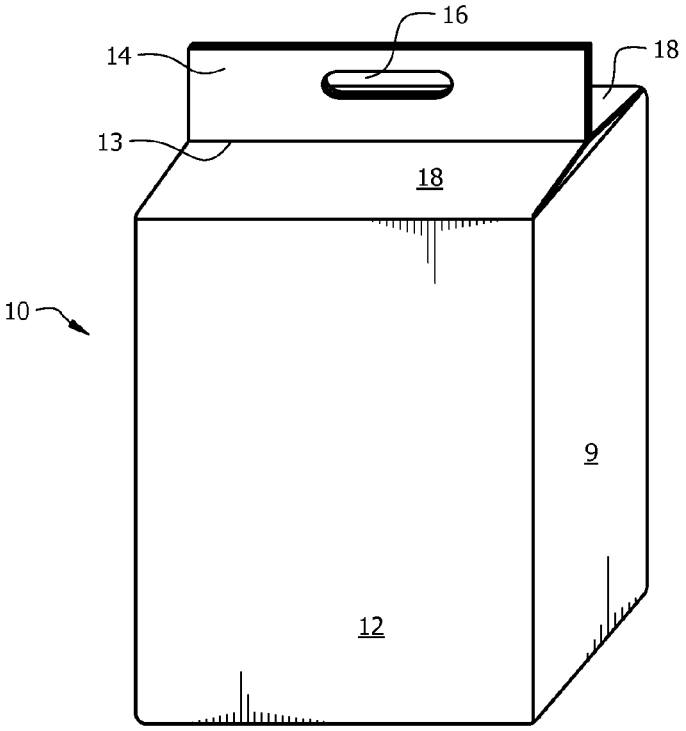
FIG. 2 illustrates a second perspective view of the container, with handles extended.

Referring to FIGS. 1 and 2, perspective views of a container 10 is shown. Generally speaking, the container 10 generally forms a cuboid or rectangular prism when full having substantially rectangular sides, a width, height and depth, though the sides do not necessarily meet at right angles (e.g. smoothed edges, rolled edges, etc.). It is anticipated that the preferred embodiment, when filled, the edges of the container 10 are rounded, thought there is no restriction and it is also anticipated that the edges are not rounded.

It is anticipated that the sides be made of a cloth-like, flexible material that, in some embodiments, has sufficient tensile strength to survive a drop test with up to 50 pounds of material, as will be described providing what is known as soft sides (as opposed to rigid side as would be found with corrugated cardboard box containers, pails or buckets.

Throughout the description and in the figures, the container 10 is shown in a filled configuration or shown as if it were full of a material such as animal litter (e.g. granular clay), water softener salt (pellets or granular), sand, concrete, dry animal feed, seed, fertilizer, etc. As shown in FIGS. 1 and 2, one can appreciate that the container 10 stands upright providing several advantages not limited to providing greater visibility to descriptive material or product claims printed on side surfaces, easy of pausing while carrying, ease of stacking/dispensing, ease of access to contents, etc. As one example of the listed attributes, when a person is carrying 60 pounds of dog food in the container 10 and needs a rest, the person extends their reach slightly and the container 10 will rest upright on the ground next to the person. To resume, the person only need extend their arm far enough to engage with the handle 16 and resume carrying the container 10. In contrast to existing bag/sack technology, the person would have to bend over to lay the bag on its face or back, then to resume the person would have to bend over to pick up the bag and, possibly, reposition the bag between the person's arm and body or carry the bag with two arms. Carrying of such a bag-type container often results in back strain or other issues.

In FIGS. 1 and 2, the container 10 is shown and the front panel 12, side panel 9 and two flaps 14/18 (upper flap section 14 and lower flap section 18) are visible (the other side panel, back panel and bottom panel are not visible). The flaps 14/18 are made of a continuous sheet of material that is folded along a fold line 13. The lower flap sections 18 extend from a top edge of the front panel 12 and a top edge of the back panel (not visible). In a preferred embodiment, a handle 16 is cut-out in the upper flap section 14 of the flaps 14/18, although it is anticipated that in some embodiments, no handle 16 is present. In FIG. 1, the flaps 14/18 are folded along the fold line 13 to lay flat for storage and stacking of the container 10. In FIG. 2, the flaps 14/18 are folded at approximately right angles along the fold line 13 to stand upright, side-by-side for carrying of the container 10. It is further anticipated that the container be carried by a single flap 14/18 (and handle 16) or that each flap 14/18 (and handle 16) is held by a different person and, in as much, carried between two people.

Figure 3:
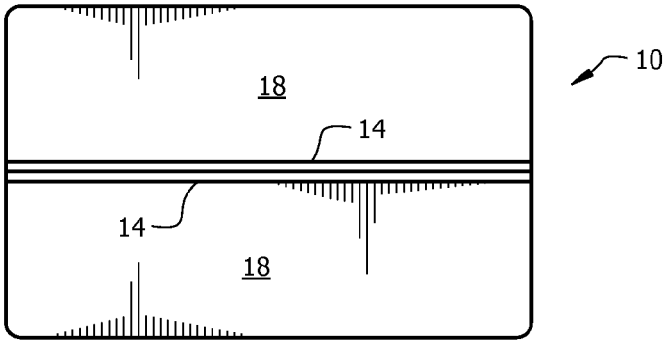
FIG. 3 illustrates a top plan view of the container, with handles extended.

Referring to FIGS. 3-6, top plan views of the container 10 are shown. In FIG. 3, the flap sections 14/18 are folded at substantially right angles to each other as in FIG. 2, and the lower flap sections 18 are visible but only the edges of the upper flap sections 14 are visible (the sides of the upper flap section 14 not visible).

Figure 4:
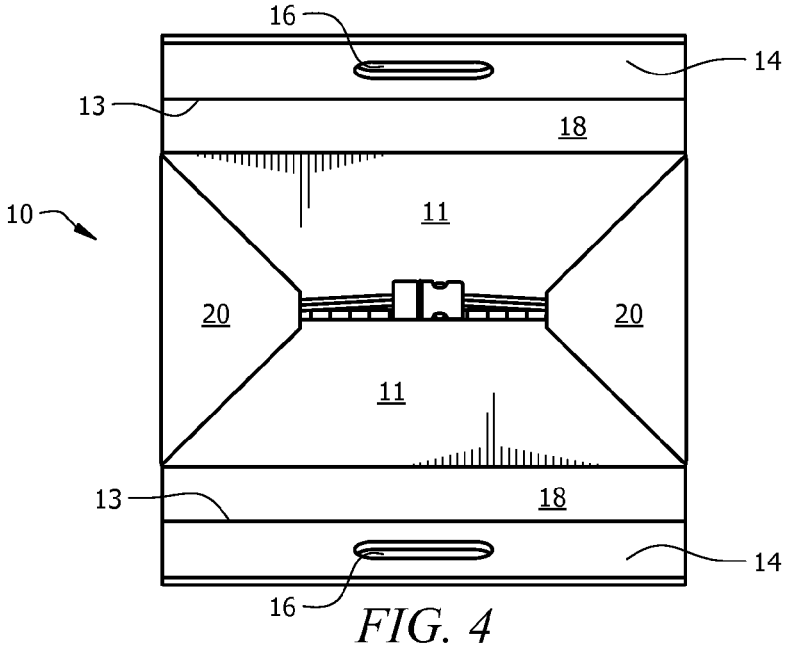
FIG. 4 illustrates a top plan view of the container with handles pulled aside and end-flaps connected.
Figure 5:
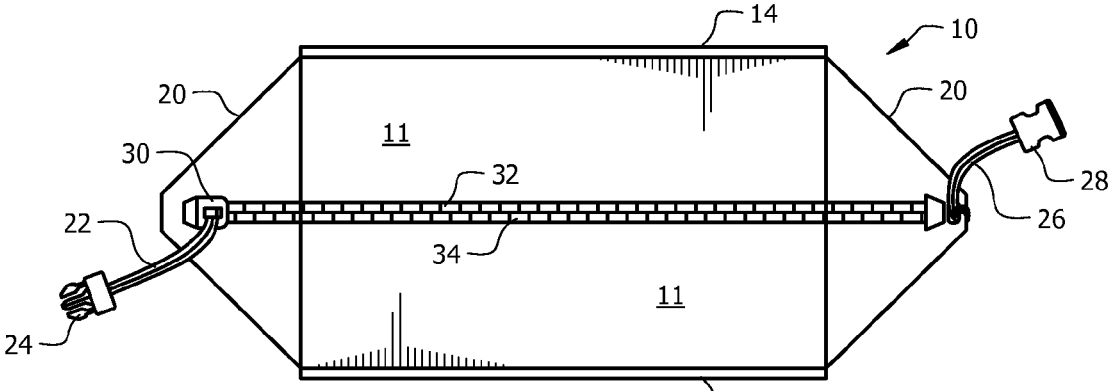
FIG. 5 illustrates a top plan view of the container with handles pulled aside and end-flaps extended.
Figure 6:
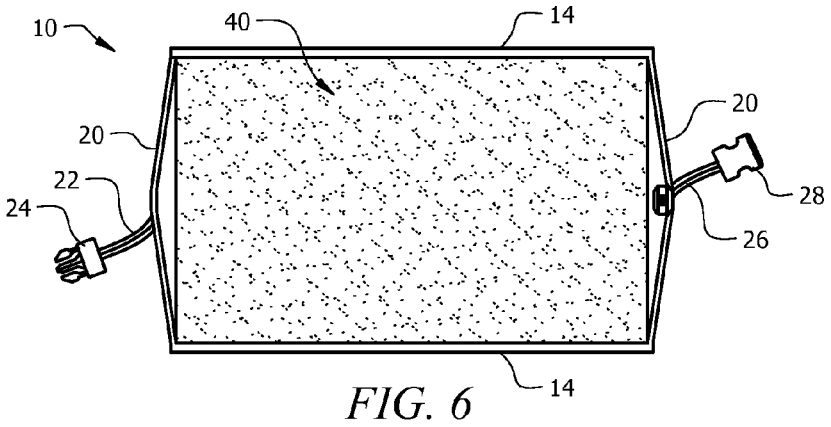
FIG. 6 illustrates a top plan view of the container with handles pulled aside, end-flaps extended, and closure device open for access to the contents.

In FIG. 4, the flaps 14/18 are extended and positioned away from the container 10, exposing the side flaps 20 and side flap retainer 22/24/26/28. The side flap retainer 22/24/26/28 holds the side flaps 20 closed for transportation and storage of the container 10 and has a fastener 24/28 that is open to extend the side flaps 20 outward for access to the contents of the container 10. In FIG. 4, the fastener 24/28 is shown engaged, thereby holding the side flaps 20 against the top surface 11 of the container 10. In FIG. 5, the fastener 24/28 is shown disengaged and the side flaps 20 are extended outwardly, exposing the elongated fastening mechanism 30/32/34 which is preferably a zipper that includes two sets of mating teeth 32/34 and a slider 30 that engages/disengages the teeth of the zipper 32/34. Although not required, it is preferred that the elongated fastening mechanism 30/32/34 cross the entire width of the top surface 11 and extend outwardly at both ends across the side flaps 20 so that, when the elongated fastening mechanism 30/32/34 is open, the side flaps 20 also open providing access to the contents 40 of the container 10 as shown in FIG. 6. In this, the opening for access to the contents 40 is substantially the full width and depth of the container 10, allowing uninhibited access to the contents 40.

Additionally, when the fastening mechanism 30/32/34 is open (or at least partially open), the side flaps 20 that are open function as a pour spouts.

The body of the container 10 is preferably made from a polypropylene material. For example, the container is made from polypropylene film that is extruded and stretched in X and Y directions, called Biaxially Oriented Polypropylene (BOPP). This material has increased strength and has been widely used as a package material (e.g. for fresh produce). Biaxially Oriented Polypropylene (BOPP) is easy to coat, print, and laminate. Polypropylene recycles well and, after the contents of the container 10 are depleted, the container 10 collapses, requiring a low amount of space during transportation to incinerators/recycling centers. Furthermore, after depletion of the contents of the container 10, the container 10 is useful for many home/business uses such as trash, leaf collection, etc. Since the container 10 is not destroyed or damages during typical use, the container 10 is refillable and/or fully recyclable and refillable.

It is anticipated that the container 10 be produced in any dimension. In some embodiments, the container 10 is produced in standard width and depth sizes with different height sizes depending upon the volume and weight of the contents 40. By standardizing on a particular width and depth, the same pallet size and storage shelf size works for several different volume/weight containers 10. For example, in a sample embodiment, a container 10 for containing 40 pounds of clay litter measures 11 inches wide, 8 inches deep and 14 inches high. By making 60 pound containers 10 with the same width (11 inches), same depth (8 inches), but different height, 21 inches, the same floor space dimensions, shelf dimensions, and/or pallet dimensions holds the same number of containers 10 in one layer, enabling transitions from one capacity container 10 to another capacity container 10 without changing storage/transportation arrangements. Since the containers 10 stack well, the horizontal space is then used to store/transport more or less containers 10. For example, two layers of 60 pound containers 10 or three layers of 40 pound containers 10.

The fastening mechanism 30/32/34 is any edge coupling fastening mechanism such as the zipper 30/32/34 as shown. Other fastening mechanisms 30/32/34 are envisioned, including, but not limited to, plastic snap seals, plastic slider zippers, hook and loop material, etc. In some embodiments, the fastening mechanism 30/32/34 is a destructive mechanism such that, after opening, there are no resealing capabilities. Examples of such are perforated tear lines, pull strings that break the top surface, etc.

Although it is preferred that the container 10 is made from a polypropylene material, any suitable material is anticipated including, but not limited to, low density polyethylene, canvas, paper, etc. It is anticipated, but not required, that a container 10 made of Polypropylene resin requires less raw material during manufacture that an equivalent volume pail/bucket/jug, resulting in lower cost and less resource usage.

The side flap retainer 22/24/26/28 shown has two resilient cords 22/26, one resilient cord 22 attached to the slider 30 and the other resilient cord 26 attached to an opposing side flap 20. Alternately, it is anticipated that the first resilient cord 22 is attached to the first side flap 20. Ends of the resilient cords 22/26 are preferably equipped with latching mechanism 24/28. Any latching mechanism 24/28 is anticipated, including, but not limited to, snap locks 24/28 (as shown), hooks, a hook and a loop, etc. It is also anticipated that the cords 22 and 26 are less resilient or not resilient (e.g. cotton cord like a shoe string) with or without a latching mechanism 24/28. In examples where there is no latching mechanism 24/28, it is anticipated that the ends of the cords 22/26 be tied together (e.g. slip knot or bowtie).

Figure 7:
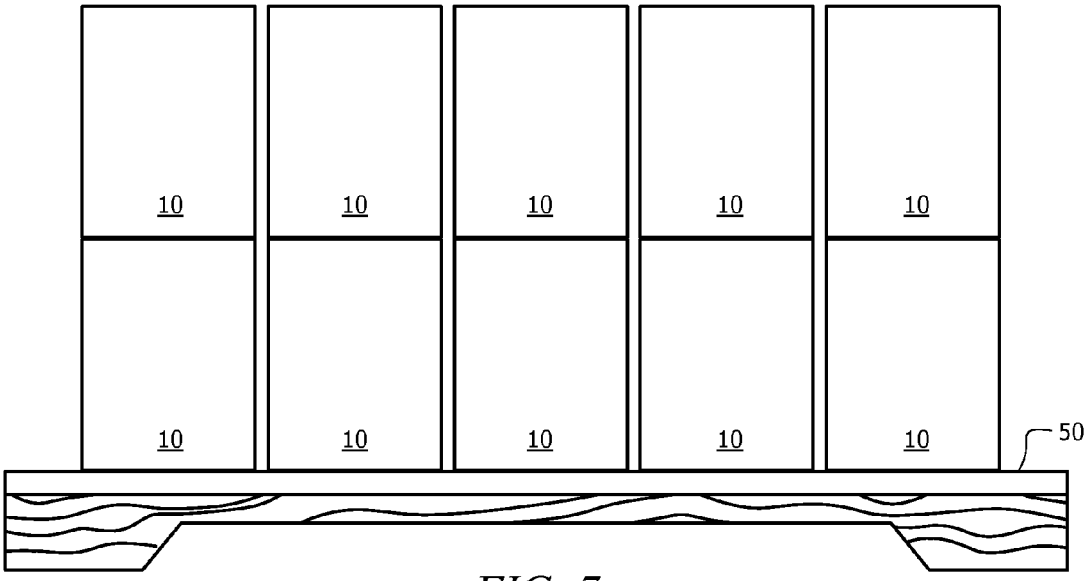
FIG. 7 illustrates a front plan view of a plurality of the containers on a pallet (We can attach a photograph of a completed pallet, if required).

Referring to FIG. 7, a front plan view of a plurality of the containers 10 on a pallet 50 is shown. This figure shows that, being that the containers 10 are substantially cuboid or rectangular prism in shape, the containers 10 stack well and are easily shrink-wrapped. The containers 10 efficiently utilize pallet and shelf space and "shrink" as contents are depleted using less space as when they were full (pails/buckets do not have this feature). Although other packaging as previously describe are capable of being stacked on a pallet, for example 60 pound bags of dog food, when stacked, the front label and predominant advertising space is not visible, except from the top of the pallet. This reduces product recognition, advertising, etc.

Figure 8:
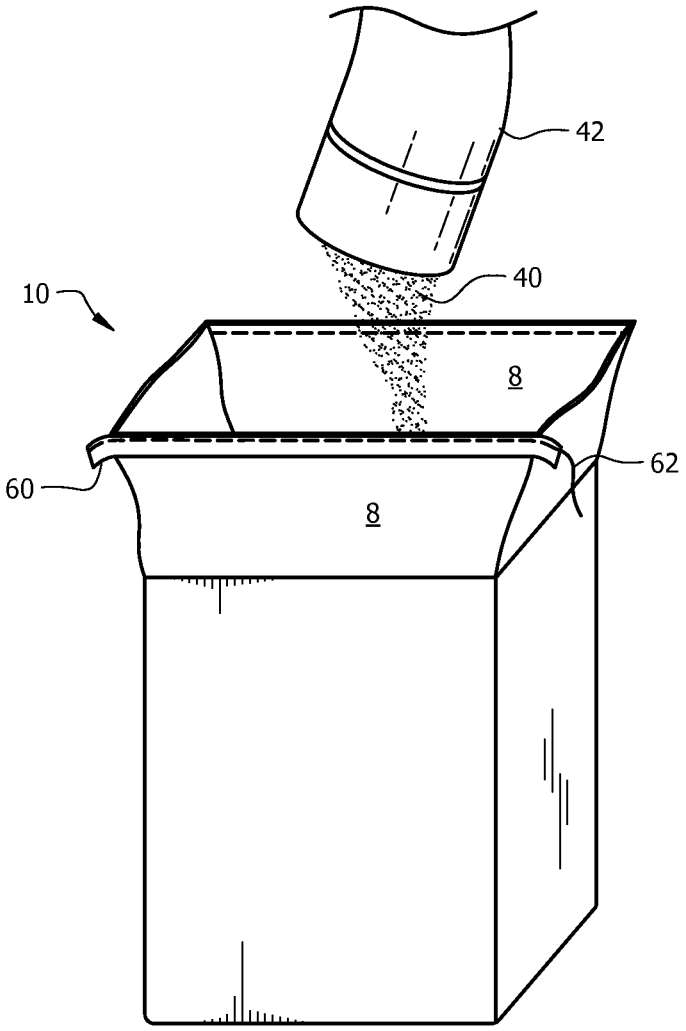
FIG. 8 illustrates a third perspective view of the container situated in an inverted position being filled with material.
Figure 9:
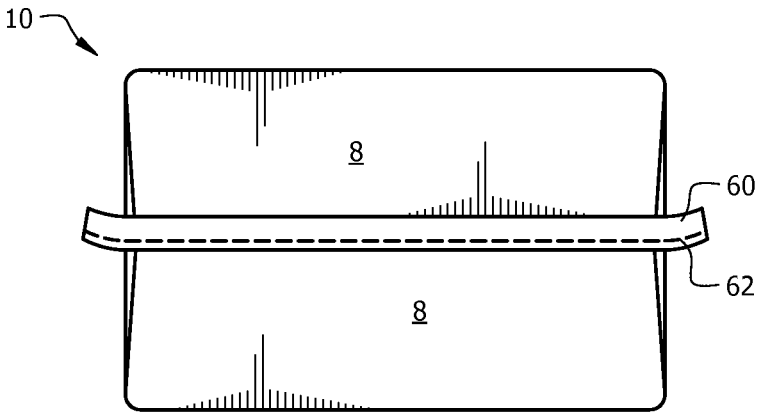
FIG. 9 illustrates a bottom plan view of the container situated in an inverted position after filled with a material and sealed by stitching.

Referring to FIGS. 8 and 9, perspective views of the container 10 situated in an inverted position being filled with a material 40 from a spout 42 are shown. Although it is anticipated that the container 10 is perfectly suited for filling through the fastening mechanisms 30/32/34, it is anticipated that the container 10 be filled from the bottom panels 8 before the bottom panels 8 are sealed. In FIG. 8, the container 10 is inverted and the bottom panels 8 open while material 40 (e.g. clay litter, animal feed, seed, etc.) is dispensed into the container 10. After the container 10 is filled to the appropriate/desired level, the bottom panels 8 are sealed, for example using a paper strip 60 and stitching 62. After the bottom panels 8 are sealed, the bottom panels 8 form a substantially flat surface as shown in FIG. 9 with rounded edges or squared edges, as desired. The seal 60/62 folds down and will lay flat against the bottom panels 8 for improved stability. Although a paper strip 60 and stitching 62 are shown in this example, any sealing mechanism device is anticipated, including, but not limited to, an adhesive seal, an ultrasonic weld, braiding, etc.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A container comprising:

four connected and substantially rectangular panels comprising a front panel, rear panel, left panel and right panel;

a substantially rectangular bottom section having four edges, each edge of the bottom section is connected to a respective bottom edge of a corresponding one of the four substantially rectangular panels;

a first flap extending from an upper edge of the front panel, the first flap having a first fold line, the first fold line being substantially parallel to the upper edge of the front panel, the first fold line dividing the first flap into an upper first flap and a lower first flap;

a second flap extending from an upper edge of the rear panel, the second flap having a second fold line, the second fold line being substantially parallel to the upper edge of the rear panel, the second fold line dividing the second flap into an upper second flap and a lower second flap;

when the first flap is bent to approximately 90 degrees at the first fold line, and the second flap is bent to approximately 90 degrees at the second fold line, the upper first flap abuts the upper second flap;

a top section, each edge of the top section connected to a respective one of the upper edge of the front panel, the upper edge of the rear panel and upper edges of each of the left and right panel, the top section having a first triangular shaped flap extending from the left panel and a second triangular shaped flap extending from the right panel, such that the first triangular shaped flap and the second triangular shaped flap fold outwardly to be pouring spouts and fold inwardly against the first flap and the second flap for carrying; and a zipper on the top section bifurcating the top section into two half top section, the zipper extending from a vertex of the first triangular shaped flap to a vertex of the second triangular shaped flap, the zipper having a closed position in which the container is sealed and an opened position in which access to the material in the container is provided such that one of the first or second triangular shaped flaps is used as a pour spout;

whereas the top section, the front panel, the rear panel the left and right panels and the bottom section substantially forming a cuboid.

2. The container of claim 1, further comprising a side flap retainer, a first end of the side flap retainer interfaced to the vertex of the first triangular shaped flap and a distal end of the side flap retainer interfaced to the vertex of the second triangular shaped flap, thereby urging the vertex of the first triangular shaped flap towards the vertex of the second triangular shaped flap and urging the first and second triangular shaped flaps to lay against the top section.

3. The container of claim 2, wherein the side flap retainer includes a fastener that disengageably connects a first length of the side flap retainer that is interfaced to the vertex of the first triangular shaped flap from a second length of the side flap retainer that is interfaced to the vertex of the second triangular shaped flap, thereby when the fastener is disengaged, the first triangular shaped flap and second triangular shaped flaps are free to bend outwardly and away from the top section.

4. The container of claim 3, wherein the fastener is a clip.

5. The container of claim 2, wherein the side flap retainer is a resilient cord.

6. The container of claim 1, wherein the four connected and substantially rectangular panels, the top section, the bottom section, the first flap, and the second flap are made of polypropylene.

7. The container of claim 1, wherein handle openings are cut/formed in the upper first flap and in the lower first flap.

8. The container of claim 1, wherein the bottom section comprises a first bottom panel and a second bottom panel, an edge of the first bottom panel that is closest to the second bottom panel interfaces with an edge of the second bottom panel that is closest to the first bottom panel.

9. The container of claim 8, wherein the edge of the first bottom panel that is closest to the second bottom panel is stitched to the edge of the second bottom panel that is closest to the first bottom panel.

10. A container comprising:

four connected and substantially rectangular panels comprising a front panel, rear panel, left panel and right panel;

a substantially rectangular bottom section comprising four edges, each edge of the bottom section is connected to a respective bottom edge of a corresponding one of the four substantially rectangular panels;

a first flap extending from an upper edge of the front panel, the first flap having a first fold line, the first fold line being substantially parallel to the upper edge of the front panel, the first fold line dividing the first flap into an upper first flap and a lower first flap, a first handle hold cut/formed in the upper first flap;

a second flap extending from an upper edge of the rear panel, the second flap having a second fold line, the second fold line being substantially parallel to the upper edge of the rear panel, the second fold line dividing the second flap into an upper second flap and a lower second flap, a second handle hold cut/formed in the upper second flap;

when the first flap is bent to approximately 90 degrees at the first fold line, and the second flap is bent to approximately 90 degrees at the second fold line, the upper first flap abuts the upper second flap;

a top section, each edge of the top section connected to a respective one of the upper edge of the front panel, the upper edge of the rear panel and upper edges of each of the left and right panel, the top section having a first triangular shaped flap extending from the left panel and a second triangular shaped flap extending from the right panel, such that the first triangular shaped flap and the second triangular shaped flap fold outwardly to be pouring spouts and fold inwardly against the first flap and the second flap for carrying; and a zipper on the top section bifurcating the top section into two half top section, the zipper extending from a vertex of the first triangular shaped flap to a vertex of the second triangular shaped flap, the zipper having a closed position in which the container is sealed and an opened position in which access to the material in the container is provided such that one of the first or second triangular shaped flaps is used as a pour spout;

a first end of a side flap retainer is interfaced to a vertex of the first triangular shaped flap and a distal end of the side flap retainer is interfaced to a vertex of the second triangular shaped flap, thereby urging the vertex of the first triangular shaped flap towards the vertex of the second triangular shaped flap and urging the first and second triangular shaped flaps to lay against the top section;

the side flap retainer comprises a fastener that disengageably connects a first length of the side flap retainer that is interfaced to the vertex of the first triangular shaped flap from a second length of the side flap container that is interfaced to the vertex of the second triangular shaped flap, thereby when the fastener is disengaged, the first triangular shaped flap and second triangular shaped flaps are free to bend outwardly and away from the top section thereby forming spouts; and the top section further comprises an elongated closure device, the elongated closure device running substantially parallel to both the upper edge of the front panel and the upper edge of the rear panel and continuing between the first triangular shaped flap and second triangular shaped flaps, the elongated closure device having a closed position in which the container is sealed and an opened position in which access to the material in the container is provided.

11. The container of claim 10, wherein the elongated closure device is a zipper.

12. The container of claim 10, wherein the four connected and substantially rectangular panels, the top section, the bottom section, the first flap, and the second flap are made of polypropylene.

* * * * *